US006616134B2

(12) United States Patent
Maresse et al.

(10) Patent No.: US 6,616,134 B2
(45) Date of Patent: Sep. 9, 2003

(54) DEVICE FOR ELECTRICALLY INSULATING ROTATING COMPONENTS IN ROTARY PRINTING MACHINES

(75) Inventors: Alain Maresse, Neufvy sur Aronde (FR); Thierra Melon, Breuil le Vert (FR)

(73) Assignee: Heidelberger Druckmaschinen AG, Heidelberg (GB)

( * ) Notice: Subject to any disclaimer, the term of this patent is extended or adjusted under 35 U.S.C. 154(b) by 0 days.

(21) Appl. No.: 09/946,738

(22) Filed: Sep. 4, 2001

(65) Prior Publication Data

US 2002/0046665 A1 Apr. 25, 2002

(30) Foreign Application Priority Data

Sep. 1, 2000 (DE) ..... 100 43 211

(51) Int. Cl.[7] ..... B41F 13/56; B65H 41/00

(52) U.S. Cl. ..... 270/52.09; 370/45; 370/58.07; 83/343; 83/346; 493/357; 493/370

(58) Field of Search ..... 270/58.07, 52.07, 270/52.08, 52.09, 52.1, 32, 45; 83/934, 87, 86, 94, 157, 401, 701, 65 R, 660, 343, 346; 493/356, 357, 370

(56) References Cited

U.S. PATENT DOCUMENTS 3,991,992 A * 11/1976 Randall et al. ..... 270/52.07
4,729,282 A * 3/1988 Kasdorf ..... 83/26
5,036,737 A * 8/1991 Glaser ..... 83/100
5,064,180 A 11/1991 Wingate
5,078,375 A * 1/1992 Steidinger ..... 270/52.09
5,897,736 A * 4/1999 Kawai et al. ..... 156/261
6,422,283 B1 * 7/2002 Okushita et al. ..... 156/521

FOREIGN PATENT DOCUMENTS

| | | |
|---|---|---|
| DE | 27 54 179 C2 | 8/1979 |
| DE | 31 17 419 C2 | 4/1982 |
| DE | 94 00 931.7 | 4/1994 |
| DE | 295 17 139 U1 | 2/1996 |
| DE | 197 13 662 A | 10/1998 |
| DE | 197 16 325 A1 | 10/1998 |
| DE | 198 60 034 A1 | 6/2000 |
| EP | 0 451 573 A1 | 10/1991 |
| GB | 2 077 235 | 12/1981 |
| WO | WO98/47802 | 10/1998 |

* cited by examiner

*Primary Examiner*—Patrick Mackey
(74) *Attorney, Agent, or Firm*—Laurence A. Greenberg; Werner H. Stemer; Ralph E. Locher

(57) ABSTRACT

A device for electrostatically charging a multilayer material web includes electrostatic charge elements assigned to outer sides of the multilayer material web, the charge elements being disposed upline of an inlet of the multilayer material web into a cylinder group of a folder, as viewed in a travel direction of the multilayer material web, the cylinder group including cylinders formed with respective outer cylindrical surfaces, the cylinders including a cutting cylinder pair having a cutting nip into which a leading end of the multilayer material web extends, the cutting cylinder pair being provided with an electrically insulated cutting tool; and a folder including the charging device.

11 Claims, 3 Drawing Sheets

2
40
40
6
6
29
30
22
23
26
8
11
13
28
14
27
15
25
10
21
24
12
16
17
9
2
1

DEVICE FOR ELECTRICALLY INSULATING ROTATING COMPONENTS IN ROTARY PRINTING MACHINES

BACKGROUND OF THE INVENTION

Field of the Invention

The invention relates to a device for electrically insulating rotating components in rotary printing machines or to aggregates, such as folders, located downline from the components, the folders being usually preceded by web-processing rotary printing machines.

The published International Patent Document WO 98/47802 is concerned with a device for electrostatically charging a multilayer strand, more particularly, a paper web that is printed in a web-processing rotary printing machine. A device for electrostatically charging a multilayer strand after the individual strand layers have been brought together by oppositely polarized charging electrodes is proposed in this International patent document. The charging electrodes are arranged at both of the outerlying sides of the strand and are formed so that they contact the strand at the outer sides thereof. According to this International patent document, the charging electrodes contacting the outer sides of the web strand are preferably formed as strand-contacting rollers and are so set against the strand as to be installed directly opposite one another and mutually pressing the strand therebetween. According to this construction heretofore known from the prior art, it is also possible to form the charging electrodes as electrically conductive brushes contacting the strand.

The published European Patent Document 0 451 573 A1 relates to a deviation or deflection device in a folder, where individual printed printing copies are separated from a multilayer material web strand. A device for dividing a printing copy stream into a number of partial streams is disclosed in the folder of a rotary printing machine proposed therein. For electrostatically charging the individual printing copies, electrostatically chargeable elements are arranged in a distributed manner in circumferential direction on two adjacent deviation or deflection cylinders. A device for guiding the printing copies to the deviation or deflection cylinders is provided below the two cooperating deviation or deflection cylinders, as well as a device for removing the printing copies from the circumferential surfaces of the respective deviation or deflection cylinders for further transporting the individual printing copies to a delivery. According to the improvement heretofore known from the European Patent 0 451 573 1, the individual electrostatically chargeable elements at the circumferential or outer cylindrical surfaces of the deviation or deflection cylinders are offset 90° from one another, so that the circumferential surfaces of the two deviation or deflection cylinders cooperating with one another, respectively, have four electrostatically chargeable elements. Polarization of the electrostatic elements is reversed during the transport of the printing copies so that the printing copies running into the nip between the deviation or deflection cylinders alternately are picked up by the one surface of one of the deviation or deflection cylinders and are pushed off by the circumferential surface of the other deviation or deflection cylinder. This results in an alternating charging of the electrostatically charged printing copies, which are separated from the material web, at conveyor belts located downline, as viewed in the travel direction of the material web, from the deviation or deflection cylinders, or gripper cylinders for accepting the printing copies at the leading edges thereof, further transport devices for the printing copies being providable downline from the gripper cylinders.

It has been found that multilayer material webs adhering to one another by static charging, lose the previously applied electrostatic charge thereof when they come in contact with the surface areas or the cutting tools of the cylinders of a cutting cylinder pair in the folder. The adhesion of the individual web strands of the multilayer material webs to one another therefore decreases. The result thereof is that relative movements between the individual web layers arise in the inlet wedge and in the outlet wedge of the corresponding cutting cylinder pair of a material web-processing folder. Relative movements of the individual material web layers, whether a relative shifting or a fluttering of the leading end of the material web or of the separated products, have an undesirable or negative effect upon the cutting precision and therefore are to be avoided. With regard to the printing copies that are separated from the leading end of the multilayer material web, the decreasing adhesive effect has the result that the respectively open pages of the products can flutter due to the resultant whipping effect, which can cause the edges to turn over.

SUMMARY OF THE INVENTION

In view of the foregoing constructions heretofore known from the prior art, it is accordingly an object of the invention to provide a device for electrically insulating rotating components in a rotary printing machine, which optimally prevents relative movements between individual material web layers of a multilayer material web, as well as consequences of the whipping effect produced when the printing copies are separated.

With the foregoing and other objects in view, there is provided, in accordance with one aspect of the invention, a device for electrostatically charging a multilayer material web, comprising electrostatic charge elements assigned to outer sides of the multilayer material web, the charge elements being disposed upline of an inlet of the multilayer material web into a cylinder group of a folder, as viewed in a travel direction of the multilayer material web, the cylinder group including cylinders formed with respective outer cylindrical surfaces, the cylinders including a cutting cylinder pair having a cutting nip into which a leading end of the multilayer material web extends, the cutting cylinder pair being provided with an electrically insulated cutting tool.

In accordance with another feature of the invention, the outer cylindrical surfaces of the cylinders of the cutting cylinder pair are provided with an electrically insulating jacket coating.

In accordance with a further feature of the invention, circumferential surface segments accomodated in respective cylinder cores of the cylinders of the cutting cylinder pair are provided with electrically insulating jacket coating sections.

In accordance with an added feature of the invention, the cutting tool is formed as an anodized cutting knife.

In accordance with an additional feature of the invention, the cutting tool is accomodated in an electrically insulated manner in a knife cylinder of the cutting cylinder pair.

In accordance with yet another feature of the invention, the charging device of the invention includes a tool holder having clamping elements for holding the cutting tool in the knife cylinder, the clamping elements being received in an insulating casing.

In accordance with yet a further feature of the invention, the charging device of the invention includes at least one electrically insulated fastener for attaching the cutting tool holder to the knife cylinder.

In accordance with yet an added feature of the invention, the fastener is surrounded by a collar-shaped insulating element formed of electrically insulating material.

In accordance with yet an additional feature of the invention, the electrically insulating element is formed of a material selected from the group consisting of a ceramic material and a PTFE or polytetrafluoroethylene component.

In accordance with still another feature of the invention, the charging device includes a charge eliminator tongue settable against the knife cylinder of the cutting cylinder pair, the charge eliminator tongue being assigned, during a stop, to the electrically insulated knife cylinder of the cutting cylinder pair.

In accordance with a concomitant aspect of the invention, there is provided a folder for processing multilayer material webs after individual layers of the multilayer material web have been brought together, including a device for electrostatically charging the multilayer material web, comprising electrostatic charge elements assigned to outer sides of the multilayer material web, the charge elements being disposed upline of an inlet of the multilayer material web into a cylinder group of a folder, as viewed in a travel direction of the multilayer material web, the cylinder group including cylinders formed with respective outer cylindrical surfaces, the cylinders including a cutting cylinder pair having a cutting nip into which a leading end of the multilayer material web extends, the cutting cylinder pair being provided with an electrically insulated cutting tool.

The advantages associated with the improvement according to the invention are primarily that the electrostatic charge, which is generated on the multilayer material web, and, therewith, the adhesive effect, is maintained when the material web leaves the inlet wedge and when the material web enters the cutting wedge, i.e., when the cutting tools and the outer cylindrical or circumferential surface areas, respectively, of the cutting cylinders of the cutting cylinder pair are contacted. Due to the electrical insulation of the circumferential surfaces by depositing an electrically insulating coating and by supporting or bearing the cutting tools in an electrically insulated manner, respectively, at the circumferential surface of the cutting cylinder, they are insulated from the discharge of the applied charge. Assurance is thereby offered that the adhesive effect at the leading free end of the multilayer material web is maintained when groove bars and cutting tools meet at the cutting cylinder pair in the cutting wedge, so that relative movements of the outer web layers do not occur with respect to the web layers situated within. This is extremely important, because the leading end of the material web is unguided when the leading end of the multilayer material web emerges from the perforating nip of the perforating cylinder pair preceding the cutting cylinder pair. The greater the adhesive effect of the mutually adhering material webs is in this state, the more securely is a passage of the inlet wedge of the cutting cylinder pair ensured. It is possible to prevent edges of the leading end of the incoming multilayer material web from turning over, because the individual material web layers of the multilayer material web adhere to one another during the passage of the cutting cylinder nip and of the preceding cutting cylinder wedge.

The consequences of the whipping effect can also be reduced due to the maintained adhesive effect of the individual layers of the multilayer printing copy, when the printing copy, respectively, is separated from the incoming material web strand, and enters into the succeeding conveyor belt pair. The whipping effect induces a serpentine motion, which continues up to the product end, in the print copies leaving the cutting nip of the cutting cylinder pair, so that the edges can turn over. The higher the dynamic effect can be maintained on the printing copy, particularly with respect to the outside layers of the multilayer material web, the lower are the results of the whipping effect, so that the quality of the printing copies separated in the cutting nip can be significantly increased, because a secure passing of the outlet wedge following the cutting nip of the cutting cylinder pair can be achieved.

In an advantageous embodiment of the invention, the circumferential surfaces of the cylinders of the cutting cylinder pair, i.e., the circumferential surfaces of the groove cylinder and of the cutting knife cylinder, can be provided with an electrically insulating coating. The electrically insulating coating preferably contains a PTFE component or can be produced from ceramic material or can contain ceramic material.

In an alternative embodiment of the cylinders of a cutting cylinder pair, the cylinders can be formed of respective cores, individual segments forming the circumferential surface area of a cylinder being accommodated at the circumferential surface thereof. The components forming the circumferential surface area of the thus structured multipartite cylinder can also be formed with an electrically insulating coating of the aforementioned materials.

In a further embodiment of the invention, the cutting tool accomodated in the cutting tool mounting support at the knife cylinder can be formed as an anodized cutting knife. In addition, the cutting tool holder itself can be held in an electrically insulating manner on the knife cylinder. For this purpose, the clamping elements accomodating the cutting tools, and the knife mounting support accomodating the clamping elements and the cutting tools can also be enclosed by an electrically insulating casing with which the aforementioned components can be introduced into the corresponding groove at the circumference of the knife cylinder. Although only one cutting tool that is accepted at the circumference of a cutting knife cylinder has been mentioned hereinabove, it is believed to be clear that the explained course of action certainly can also be applied when a number of cutting tools are accommodated at the circumference of a cutting knife cylinder.

In addition to the accommodation of the cutting tool holder for holding the cutting tools in an electrically insulating casing in a groove at the circumference of the knife cylinder, the cutting tools can yet be attached by electrically insulating fasteners to the circumference of the knife cylinder. For this purpose, the knife mounting supports accommodating the cutting tools can be fastened with screws to the cylinder or to the cylinder core, the screws being provided with electrically insulated collar elements. Assurance is thereby provided that charge flow or leakage does not occur via the cutting tool mounting support to the further components of the knife cylinder of a cutting knife pair and that the adhesive effect of the individual layers of a multilayer material web upon one another is maintained as a result of the electrostatic charge, whenever contact is made by the leading end of the multilayer material web which is electrostatically charged.

In a further improvement of the invention, a charge elimination device for the electrostatic charge, which can be activated upon stopping the operation of the cutting cylinder pair, is assigned to the corresponding cylinder of the cutting cylinder pair accommodating the electrically insulated cutting tools. The proposed charging device of the invention can be advantageously employed for multilayer material web-processing folders, which are used in newspaper rotary printing presses or in jobbing or commercial web-fed rotary printing machines. The folders can be formed as folders having a pinless operation or can be formed as combination folders.

Other features which are considered as characteristic for the invention are set forth in the appended claims.

Although the invention is illustrated and described herein as embodied in a device for electrically insulating rotating components in rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
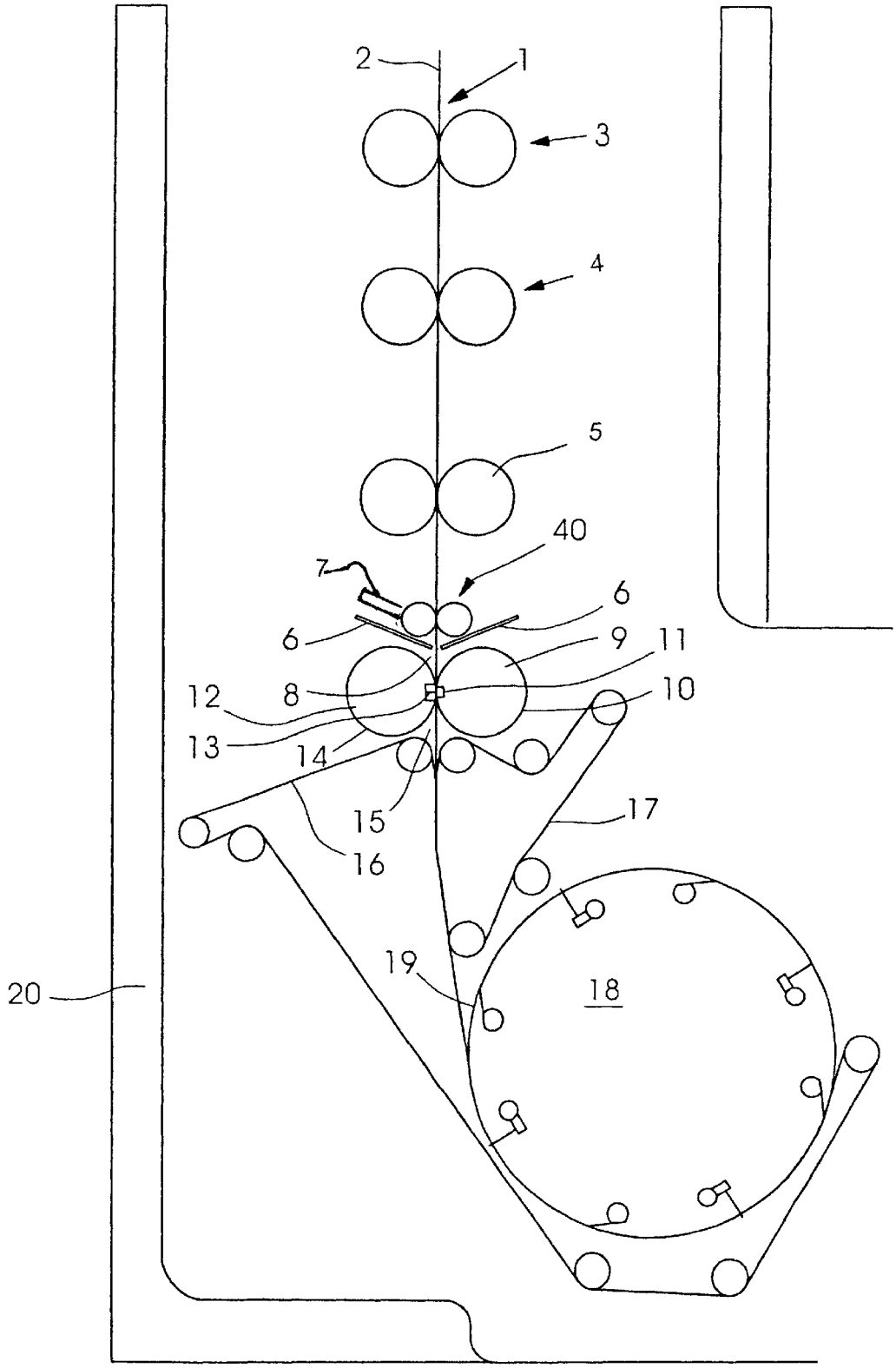
FIG. 1 is a highly diagrammatic side elevational view of the inlet region of a multilayer material web through draw or pull roller pairs into a cutting cylinder pair with a multisized folding cylinder.

Referring now to the drawings and, first, particularly to FIG. 1 thereof, there is shown therein diagrammatically a side elevational view of a partially cut-open folder preceded by web-processing rotary printing machines such as newspaper printing presses or job or commercial printing machines.

A web path 1 of a multilayer material web 2, after passing a first longitudinal folding device, runs into a folder in a substantially vertical orientation. The material web 2 normally has individual layers, which, in the turner bar superstructures preceding the folder, are combined into a material web that is composed of a number of layers before it runs into the cylinder part of a folder. A draw roller pair 3 transports the multilayer material web 2 in a substantially vertical direction, the draw roller pair 3 being followed by a further draw roller pair 4, as viewed in the material-web running or travel direction. Proceeding from the further draw roller pair 4, the web, in a vertically oriented manner, runs into a perforating nip between two cooperating perforating rollers 5. The perforating rollers 5, which are disposed, respectively, at both outer sides of the multilayer material web 2 of the web path 1, include a stationarily borne perforating roller and a further perforating roller that can be set relative to the stationary perforating roller. The further perforating roller of the perforating roller pair 5 is set against the stationarily accepted perforating roller of the perforating roller pair 5 by a setting device 7, which can be manually or electromotively operated, for example. Based upon the setting device 7, the perforating depth can be adapted to the thickness of the multilayer webs 2, which, along the web path 1, pass through the perforating nip between the perforating rollers of the perforating roller pair 5.

The perforating rollers 5 are followed by an inlet wedge 8, which is limited by the respective circumferential surfaces of the cylinders 9 and 12 of the cutting cylinder pair. Electrostatic charge elements 6 project into the inlet wedge 8 and are formed as bar-shaped elements in the configuration according to FIG. 1. Instead of electrostatic elements configured in a bar-shaped manner, rollers having jackets which are electrostatically charged can also be used, as well as electrostatically chargeable brushes.

The cutting cylinder pair shown in FIG. 1 includes a groove cylinder 9 and a knife cylinder 12 cooperating with the groove cylinder 9. The groove cylinder 9 is formed with a circumferential surface 10, and the knife cylinder 12 with a circumferential surface area 14. A cutting tool borne in a knife mounting support is accomodated at the circumference of the knife cylinder 12 of FIG. 1. In the exemplary embodiment of a cutting cylinder pair shown in FIG. 1, each of the cylinders thereof is formed with a diameter like the other, however, it is possible to accommodate a plurality of cooperating cutting tools and groove bars 11, respectively, at the circumference of the cylinders 9 and 12 of the cutting cylinder pair.

Conveyor belts 16 and 17, respectively, are disposed below the cutting nip outlet 15, between the cooperating cylinders 9 and 12 of the cutting cylinder pair, the conveyor belts 16 and 17 accepting the printing copies separated in the cutting nip outlet 15 of the cutting cylinder pair from the leading end of the multilayer material web 2, and supplying the printing copies to the circumferential surface 19 of a folding cylinder 18. The folded copies separated from the leading end of a multilayer material web 2 are transported, without being punctured by pins, between the conveyor belts 16 and 17, which are set against one another, to the circumferential surface 19 of the folding cylinder 18. The folded copies are held at the circumferential surface 19 of the folding cylinder 18 by the conveyor belt partially extending around the circumferential surface 19 of the folding cylinder 18. In the exemplary embodiment of FIG. 1, the folding cylinder 18 is of multi-sized configuration, i.e., at least two successively lying folded copies can be accommodated on the circumference 19 of the cylinder 18 before those copies can be processed further in the folding jaw cylinder following the folding cylinder 18. The folder has a side wall 20 resting on a pedestal, and is shown only diagrammatically, and is not a subject of the invention herein.

Figure 2:
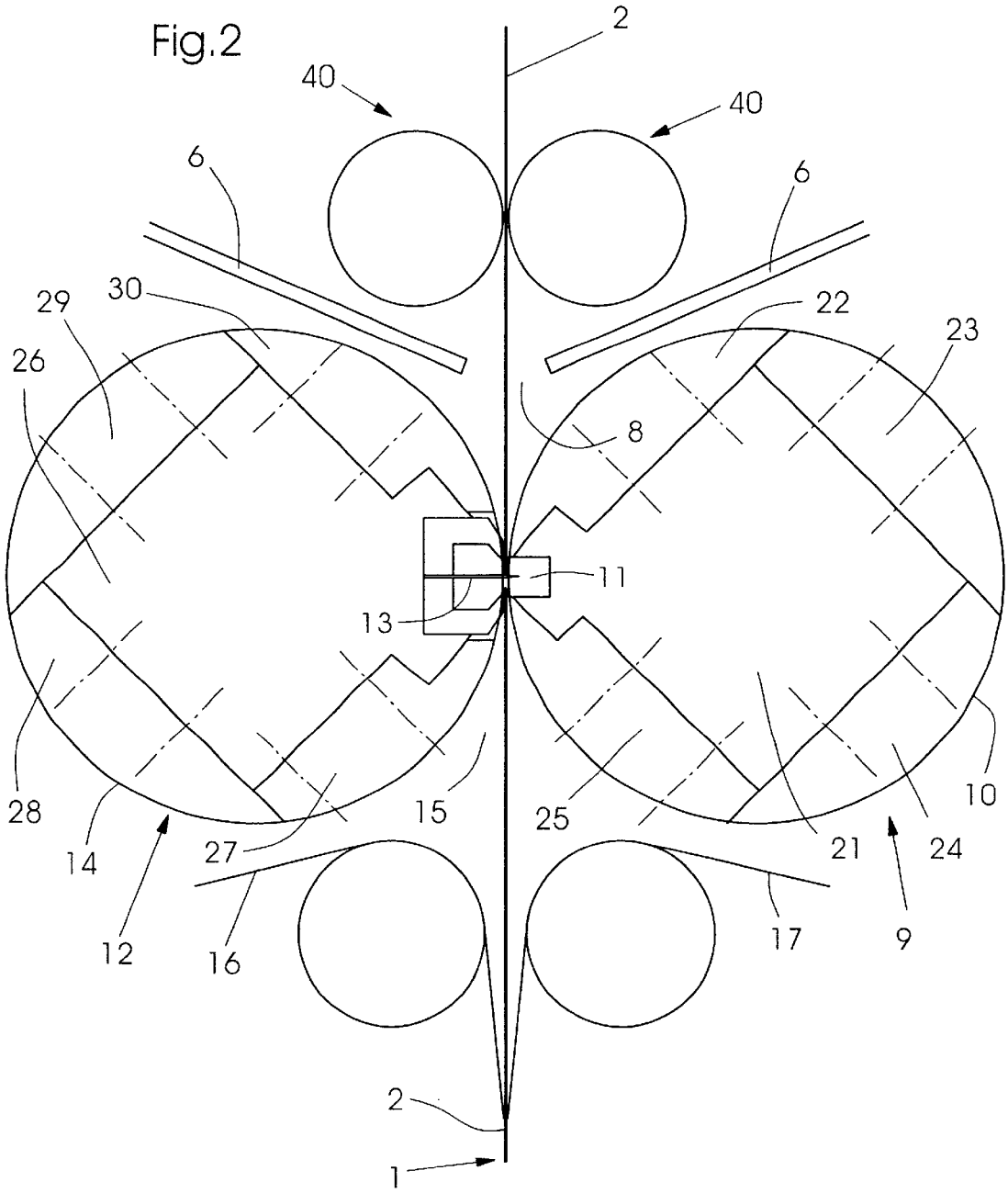
FIG. 2 is an enlarged fragmentary view of FIG. 1, showing the cutting cylinder pair with an upline inlet wedge into which the electrostatic charge elements project, and an outlet wedge for the printing copies separated from the multilayer material web, the outlet wedge being located downline from the nip of the cutting cylinder pair.

FIG. 2 shows in an enlarged view, the cutting cylinder pair having a cutting cylinder, and a groove bar cooperating therewith, the cylinders of the cutting cylinder pair having a single-size diameter, i.e., the outer cylindrical surfaces thereof being capable of accomodating only a single conventional sheet size.

The multilayer material web 2, which runs into the perforating roller pair 5 in a strictly vertical position, passes the perforating roller pair 5, of which one perforating roller is stationarily borne, whereas the other perforating roller is formed so that it can be set against the stationary perforating roller. The charging elements 6 generating the electrostatic charge on the multilayer material web 2 project into the cutting cylinder wedge 8 following the perforating roller pair 5 without touching the outsides of the inwardly running multilayer material web 2.

In the illustrated exemplary embodiment, the groove cylinder 9 of the cutting cylinder pair, and the knife cylinder 12 of the cutting cylinder pair both are configured as cylinders which are composed of segmented surfaces. The groove cylinder 9 contains a cylinder core 21, of which segments 22, 23, 24 and 25, which are fixable to one another with precise fit, can be accomodated at the outer cylindrical surface 10 of the cylinder 9. The groove bar 11 is accomodated between the segments 22 and 25 at the groove cylinder core 21, the cutting tool of the oppositely positioned knife cylinder 12 dipping or penetrating into the groove bar 11 during the process of separating a printing copy from the multilayer material web 2.

The outer cylindrical surface area 10 of the groove cylinder 9 is thus defined by four precisely joined segments 22, 23, 24 and 25, however, in an alternative embodiment of the groove cylinder 9, the latter could also be produced in one piece from holohedral material.

A knife cylinder 12, which has a knife cylinder core 26 and which cooperates with the groove cylinder 9, is arranged on the opposite side of the web path 1. Four circumferential segments 27, 28, 29 and 30 are fastened at the surfaces of the knife cylinder core 26, a cutting tool supporting or holding unit carrying a cutting knife being arranged between the circumferential segments 27 and 30. The cutting cylinder 12 formed of the segments 27, 28, 29 and 30, as well as of a knife cylinder 26, can also be formed as a one-piece component.

A cutting nip outlet 15 is formed on the outlet side of the cutting cylinder pair, the printing copies separated during the separating process from the leading end of the multilayer material web 2 leaving the cutting nip via the cutting nip outlet 15 and being guided therethrough in a flutter-free manner due to the maintained electrostatic charging and the associated adhesive effect of the individual layers of the multilayer material web 2 upon one another. The folded copies separated in the cutting nip between the cylinders 9 and 12 of the cutting cylinder pair are subsequently grasped, without being punctured, by the conveyor belts 16 and 17, respectively, cooperating with one another before they, in the vertical direction along the web path 1, are supplied to the outer cylindrical surface 19 of the multiple-sized folding cylinder 18 (note FIG. 1).

Figure 3:
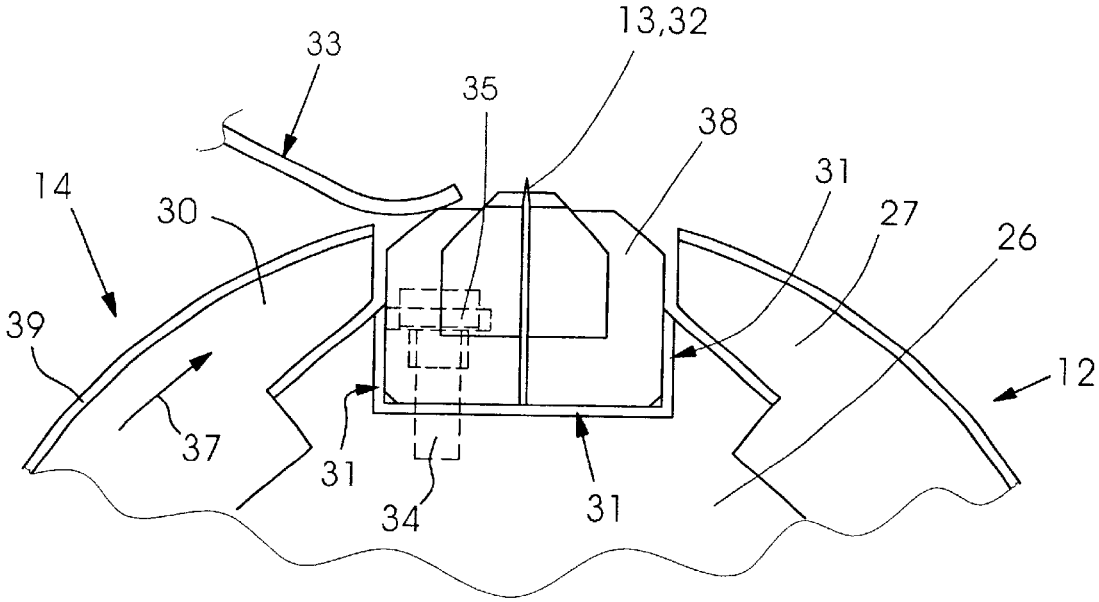
FIG. 3 is an enlarged fragmentary view of FIG. 2 showing the knife cylinder of the cutting cylinder pair rotated 90° clockwise and provided with a cutting-tool supporting or holding unit.

FIG. 3 is an enlarged view of clamping elements 38 of a cutting tool supporting unit shown in FIG. 2.

The cutting cylinder 12, which is fragmentarily shown in FIG. 3, is a cutting cylinder having the partially shown circumferential segments 27 and 30, respectively, accomodated in the knife cylinder core 26 thereof. In FIG. 3, both segments 27 and 30 are surrounded by an insulating coating 39, which can be produced from ceramic material or from material containing PTFE components, for example. The individual circumferential segments 27 and 30, respectively, defining the outer cylindrical surface area 14 of the knife cylinder 12 (as shown in FIG. 3) are accomodated in the knife cylinder core 26 with a precise fit, so that the formation of the outer cylindrical surface area 14 is assured without interruptions on the cutting knife cylinder 12. The coating 39 of the circumferential surface 14 of the knife cylinder 12 prevents the charge electrostatically applied by the electrostatic charging elements 6 to the multilayer material web 2 in the inlet wedge 8 (note FIG. 2) from being eliminated if the leading end of the multilayer material web 2 were otherwise to have contacted the circumferential surface 14, and thus prevents the adhesive effect of the individual layers of the multilayer webs 2 upon one another from decreasing. Also derived from FIG. 3 is that the clamping elements 38 of a cutting tool supporting unit, enclosed by a casing formed of electrically insulating material, can be introduced into the corresponding mounting groove at the circumference of the knife cylinder 12. Assurance is thereby provided that a discharge of the charge into the interior of the metallic cutting cylinder 12 can be prevented when the electrostatically charged leading end of the multilayer material web 2 comes in contact with the knife mounting support 38 or with the clamping elements or with the cutting tool 13 itself. Furthermore, it is believed to be apparent from FIG. 3 that the clamping elements 38 of the cutting tool supporting unit can be screwed down by fastening elements 34 to the knife cylinder core 26 of the knife cylinder 12. In order to insulate the fastening elements 34 electrically, they can be provided, in the head region thereof, with a collar element 35 that is formed of electrically insulating material, so that no electrically conducting connection exists between the knife cylinder core 26 and the cutting tool 13 and the cutting tool mounting support 38 therefor, which is accomodated in a groove formed in the knife cylinder 12. As shown in FIG. 3, the cutting tool supporting unit 38 is thereby insulated from the remaining cylinder formed of metallic material. This is also true for the outer cylindrical surface area 14 of the knife cylinder 12, which is provided with the electrically insulating coating 39.

For ensuring a discharge of the electrically insulated knife mounting support 38 of the clamping jaws and of the cutting tool 13 accomodated therein, whether it is a conventional cutting knife or an anodized cutting knife, when the cutting cylinder pair is shut down, charge eliminator tongues 33 can be arranged in the folder at a location of the cylinder supporting unit in order to ensure a discharge of the cutting tool, so that a person responsible for the maintenance or resetting of a folder is protected against static discharges.

Figure 4:
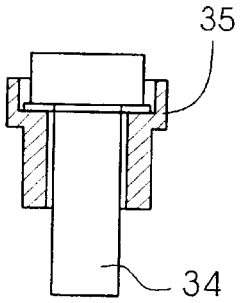
FIG. 4 is an enlarged fragmentary view of FIG. 3 showing in greater detail an insulating collar element surrounding a fastening screw.

FIG. 4 shows in greater detail a fastening element that is provided with an insulating collar.

Diagrammatically shown in FIG. 4 is one of a plurality of screws with which the clamping jaws 38 of the cutting knife supporting unit are connected to the metallic core 26 of a knife cylinder 12, while assuring that no electrically conducting connection between the fastening screw 34 and the cutting knife mounting support 38 and the metallic knife cylinder 12 exists. Detachable fastening elements 34 in the form of fastening screws, however, are necessary for rapidly exchanging worn-out cutting knives and the supporting unit elements 38 thereof at the circumference of the knife cylinder 12, whether it is configured as one piece or formed of a number of circumferential segments 27, 28, 29 and 30 (note FIG. 3).

Because the fastening elements 34 penetrate the electrically insulating casing 31 of the cutting knife mounting support and the cutting knife supporting unit 38, respectively, a separate electrical insulation of the fastening elements must be provided. This is provided by collar-shaped insulating elements 35, which are produced from ceramic material or from PTFE materials and which are placed around the fastening screws 34.

According to the invention, the proposed electrical insulation of the circumferential surfaces 14 and 10 of the cylinders 9 and the cutting cylinder pair, respectively, makes it possible to maintain the electrostatic charging of a multilayer material web 2 from which individual folded copies are separated in the cutting nip between the cutting tools 13 and the groove bars 11, the electrostatic charge being applied in the cutting cylinder wedge 8. The quality of the produced folding products can be increased considerably in accordance with the invention due to the maintained adhesive effect during the passage of the cutting cylinder pair. The adhesion of the outer layers of the multilayer material web 2 achieved in accordance with the invention is of particular importance, because a turn-over of edges can be prevented effectively. The consequences of the whipping effect, after the printing copy has been separated from the respective leading end of the multilayer material web 2, can be reduced by maintaining the electrostatically generated adhesion on the outer layers of the multilayer material web 2 for a longer period of time. The inventive improvement can be used advantageously for material web-processing folders of web-fed rotary printing machines, whether they are combination folders or pinless folders. The web-fed rotary printing machines can be newspaper rotary printing presses for larger editions or can be jobbing or commercial web-fed rotary printing machines.

We claim:

1. A device for electrostatically charging a multilayer material web, comprising electrostatic charge elements assigned to outer sides of the multilayer material web, said charge elements being disposed upline of an inlet of the multilayer material web into a cylinder group of a folder, as viewed in a travel direction of the multilayer material web, said cylinder group including cylinders formed with respective outer cylindrical surfaces, said cylinders including a cutting cylinder pair having a cutting nip into which a leading end of the multilayer material web extends, said cutting cylinder pair being provided with an electrically insulated cutting tool.

2. The device according to claim 1, wherein said outer cylindrical surfaces of said cylinders of said cutting cylinder pair are provided with an electrically insulating jacket coating.

3. The device according to claim 1, wherein circumferential surface segments accomodated in respective cylinder cores of said cylinders of said cutting cylinder pair are provided with electrically insulating jacket coating sections.

4. The device according to claim 1, wherein said cutting tool is formed as an anodized cutting knife.

5. The device according to claim 1, wherein said cutting tool is accomodated in an electrically insulated manner in a knife cylinder of said cutting cylinder pair.

6. The device according to claim 5, including a tool holder having clamping elements for holding said cutting tool in said knife cylinder, said clamping elements being received in an insulating casing.

7. The device according to claim 5, including at least one electrically insulated fastener for attaching said cutting tool holder to said knife cylinder.

8. The device according to claim 7, wherein said fastener is surrounded by a collar-shaped insulating element formed of electrically insulating material.

9. The device according to claim 8, wherein said electrically insulating element is formed of a material selected from the group consisting of a ceramic material and a PTFE component.

10. The device according to claim 5, including a charge eliminator tongue settable against said knife cylinder of said cutting cylinder pair, said charge eliminator tongue being assigned, during a stop, to said electrically insulated knife cylinder of said cutting cylinder pair.

11. A folder for processing multilayer material webs after individual layers of the multilayer material web have been brought together, including a device for electrostatically charging the multilayer material web, comprising electrostatic charge elements assigned to outer sides of the multilayer material web, said charge elements being disposed upline of an inlet of the multilayer material web into a cylinder group of a folder, as viewed in a travel direction of the multilayer material web, said cylinder group including cylinders formed with respective outer cylindrical surfaces, said cylinders including a cutting cylinder pair having a cutting nip into which a leading end of the multilayer material web extends, said cutting cylinder pair being provided with an electrically insulated cutting tool.

* * * * *